US011319661B1

(12) United States Patent
Maryanski et al.

(10) Patent No.: US 11,319,661 B1
(45) Date of Patent: May 3, 2022

(54) VENTILATION SOLUTION FOR CLOSED-LOOP DRYER SYSTEMS

(71) Applicant: WHIRLPOOL CORPORATION, Benton Harbor, MI (US)

(72) Inventors: Nolan R. Maryanski, Stevensville, MI (US); Antonio Mazzarella, Fabriano (IT); Justin Nguyen, Wyoming, MI (US); Pedro A. Rouin, Stevensville, MI (US); Daniel A. Schurr, Wyoming, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/130,626

(22) Filed: Dec. 22, 2020

(51) Int. Cl.

| | |
|---|---|
| ***D06F 58/20*** | (2006.01) |
| ***D06F 33/06*** | (2006.01) |
| ***D06F 58/26*** | (2006.01) |
| ***D06F 33/63*** | (2020.01) |
| *D06F 105/32* | (2020.01) |
| *D06F 103/32* | (2020.01) |
| *D06F 59/00* | (2006.01) |

(52) U.S. Cl.
CPC ..... *D06F 58/206* (2013.01); *D06F 33/06* (2013.01); *D06F 33/63* (2020.02); *D06F 58/26* (2013.01); *D06F 59/00* (2013.01); *D06F 2103/32* (2020.02); *D06F 2105/32* (2020.02)

(58) Field of Classification Search
CPC ..... D06F 58/206; D06F 58/26; D06F 33/63; D06F 33/06; D06F 2105/32; D06F 2103/32
USPC ..... 34/595–610
See application file for complete search history.

(56) References Cited

U.S. PATENT DOCUMENTS

| | | | | |
|---|---|---|---|---|
| 4,689,896 | A * | 9/1987 | Narang | D06F 58/20 34/82 |
| 4,891,892 | A * | 1/1990 | Narang | D06F 58/20 34/86 |
| 6,904,703 | B2 * | 6/2005 | Naganawa | D06F 43/086 34/596 |
| 7,021,088 | B2 | 4/2006 | Hong et al. | |
| 7,913,419 | B2 * | 3/2011 | Tomasi | D06F 29/00 34/595 |
| 8,539,694 | B2 | 9/2013 | Moon et al. | |
| 9,285,166 | B2 * | 3/2016 | Tezcan | F26B 21/12 |

(Continued)

FOREIGN PATENT DOCUMENTS

| | | | | |
|---|---|---|---|---|
| CA | 2540368 C | * | 12/2012 | D06F 25/00 |
| EP | 3418438 | | 12/2018 | |

(Continued)

*Primary Examiner* — Stephen M Gravini
(74) *Attorney, Agent, or Firm* — Price Heneveld LLP

(57) ABSTRACT

A drying appliance includes a cabinet. A drum processes articles of laundry. The drum is positioned for rotational operation within the cabinet. A blower directs process air through a recirculating airflow path that includes the drum. The drum and the blower are activated in an operating state and deactivated in an idle state. A first operable vent is positioned proximate a front of the cabinet. A second operable vent is positioned proximate a rear of the cabinet. The first and second operable vents define an open position after the drum and the blower define the idle state. The first and second operable vents define a closed position after the drum and the blower define the operating state.

20 Claims, 9 Drawing Sheets

(56) References Cited

U.S. PATENT DOCUMENTS

| | | | | |
|---|---|---|---|---|
| 9,416,475 | B2 * | 8/2016 | Kulkarni | D06F 25/00 |
| 9,422,662 | B2 * | 8/2016 | Caldeira | D06F 58/206 |
| 9,488,412 | B2 * | 11/2016 | Yu | F26B 25/005 |
| 10,039,434 | B2 * | 8/2018 | Park | A47L 15/483 |
| 10,273,628 | B2 * | 4/2019 | Je | D06F 58/50 |
| 10,400,385 | B2 * | 9/2019 | Brown | D06F 58/30 |
| 10,697,104 | B2 | 6/2020 | Ficke et al. | |
| 10,815,610 | B2 * | 10/2020 | Lee | B08B 3/02 |
| 10,947,661 | B2 * | 3/2021 | Je | D06F 58/206 |
| 10,988,895 | B2 * | 4/2021 | Kim | D06F 58/50 |
| 11,060,236 | B2 * | 7/2021 | Djerekarov | D06F 58/206 |
| 11,125,500 | B2 * | 9/2021 | Diaz | F26B 23/004 |
| 2005/0066538 | A1 * | 3/2005 | Goldberg | D06F 58/206 34/218 |
| 2016/0244904 | A1 | 8/2016 | Broitzman | |
| 2019/0032269 | A1 | 1/2019 | Gijare et al. | |

FOREIGN PATENT DOCUMENTS

| | | | | |
|---|---|---|---|---|
| KR | 100935433 | B1 * | 1/2010 | D06F 25/00 |
| WO | WO-2005032322 | A3 * | 10/2005 | D06F 25/00 |
| WO | 2016078192 | | 5/2016 | |
| WO | 2019228244 | | 12/2019 | |

* cited by examiner

| | Treatment 10 | | Treatment 9 | |
|---|---|---|---|---|
| Time (minutes) | $O_2$% | $CO_2$% | $O_2$% | $CO_2$% |
| 0 | 21.01 | 0.00 | 21.01 | 0.00 |
| 5 | 19.74 | 0.99 | 19.74 | 1.02 |
| 10 | 18.64 | 1.81 | 18.72 | 1.79 |
| 15 | 18.24 | 2.11 | 18.13 | 2.22 |
| 20 | 18.00 | 2.29 | 17.86 | 2.41 |
| 25 | 17.90 | 2.36 | 17.82 | 2.46 |
| 30 | 17.89 | 2.37 | 17.73 | 2.49 |
| 35 | 17.90 | 2.35 | 17.74 | 2.50 |
| 40 | 17.92 | 2.32 | 17.75 | 2.49 |
| 45 | 17.97 | 2.29 | 17.76 | 2.47 |
| 50 | 18.00 | 2.26 | 17.79 | 2.45 |
| 55 | 18.02 | 2.24 | 17.83 | 2.41 |
| 60 | 18.04 | 2.21 | 17.85 | 2.39 |
| 65 | 18.07 | 2.19 | 17.90 | 2.34 |
| 70 | 18.09 | 2.17 | 17.92 | 2.31 |
| 75 | 18.10 | 2.17 | 17.95 | 2.28 |
| 80 | 18.12 | 2.15 | 17.97 | 2.27 |
| 85 | 18.12 | 2.14 | 18.00 | 2.25 |
| 90 | 18.12 | 2.14 | 17.99 | 2.25 |
| 95 | 18.13 | 2.13 | 18.00 | 2.24 |
| 100 | 18.13 | 2.13 | 18.03 | 2.23 |
| 105 | 18.17 | 2.09 | 18.05 | 2.21 |
| 110 | 18.19 | 2.08 | 18.05 | 2.21 |
| 115 | 18.19 | 2.07 | 18.04 | 2.21 |
| 120 | 18.20 | 2.07 | 18.05 | 2.21 |
| RESULT | PASS | | PASS | |
| CONTAINMENT | | | | |

FIG. 10

VENTILATION SOLUTION FOR CLOSED-LOOP DRYER SYSTEMS

FIELD OF THE DEVICE

The device is in the field of laundry appliances, and more specifically, a ventilation system for a closed-loop drying device that provides for ventilation within the rotating drum when the appliance is deactivated. Closed loop systems typically include an airflow path that does not provide for a flow of air when the appliance is deactivated. When the appliance is turned off and the door to the appliance is closed, carbon dioxide and other noxious gasses can accumulate within the drum when an individual or creature is in the drum of the deactivated appliance.

SUMMARY OF THE DISCLOSURE

According to one aspect of the present disclosure, a drying appliance includes a cabinet. A drum processes articles of laundry. The drum is positioned for rotational operation within the cabinet. A blower directs process air through a recirculating airflow path that includes the drum. The drum and the blower are activated in an operating state and deactivated in an idle state. A first operable vent is positioned proximate a front of the cabinet. A second operable vent is positioned proximate a rear of the cabinet. The first and second operable vents define an open position after the drum and the blower define the idle state. The first and second operable vents define a closed position after the drum and the blower define the operating state.

According to another aspect of the present disclosure, a ventilation system for a drying appliance includes a blower that directs process air through a recirculating airflow path in an operating state. The recirculating airflow path includes a processing chamber. Deactivation of the blower defines an idle state. A first operable vent is positioned proximate a front portion of the recirculating airflow path. A second operable vent is positioned proximate a rear portion of the recirculating airflow path. The first and second operable vents define a closed position during the operating state that is indicative of the recirculating airflow path being a closed-loop system. The first and second operable vents define an open position during the idle state that forms a venting airflow of ambient air through the processing chamber and between the first and second operable vents.

According to yet another aspect of the present disclosure, a drying appliance includes a blower that directs process air through a recirculating airflow path that includes a drum. A heater selectively heats the process air, wherein at least one of the blower, the drum and the heater are activated in an operating state and wherein all of the blower, the drum and the heater are deactivated in an idle state. A first temperature-operable vent is positioned proximate a front of a cabinet. A second temperature-operable vent is positioned proximate a rear of the cabinet. The first and second temperature-operable vents define an open position after the blower, the drum and the heater define the idle state. The first and second temperature-operable vents define a closed position after at least the blower and the heater define the operating state.

These and other features, advantages, and objects of the present disclosure will be further understood and appreciated by those skilled in the art by reference to the following specification, claims, and appended drawings.

BRIEF DESCRIPTION OF THE DRAWINGS

In the drawings:

FIG. 10 is a schematic diagram illustrating recordings of exemplary oxygen and carbon dioxide levels within an aspect of the ventilation system described herein.

Figure 1:
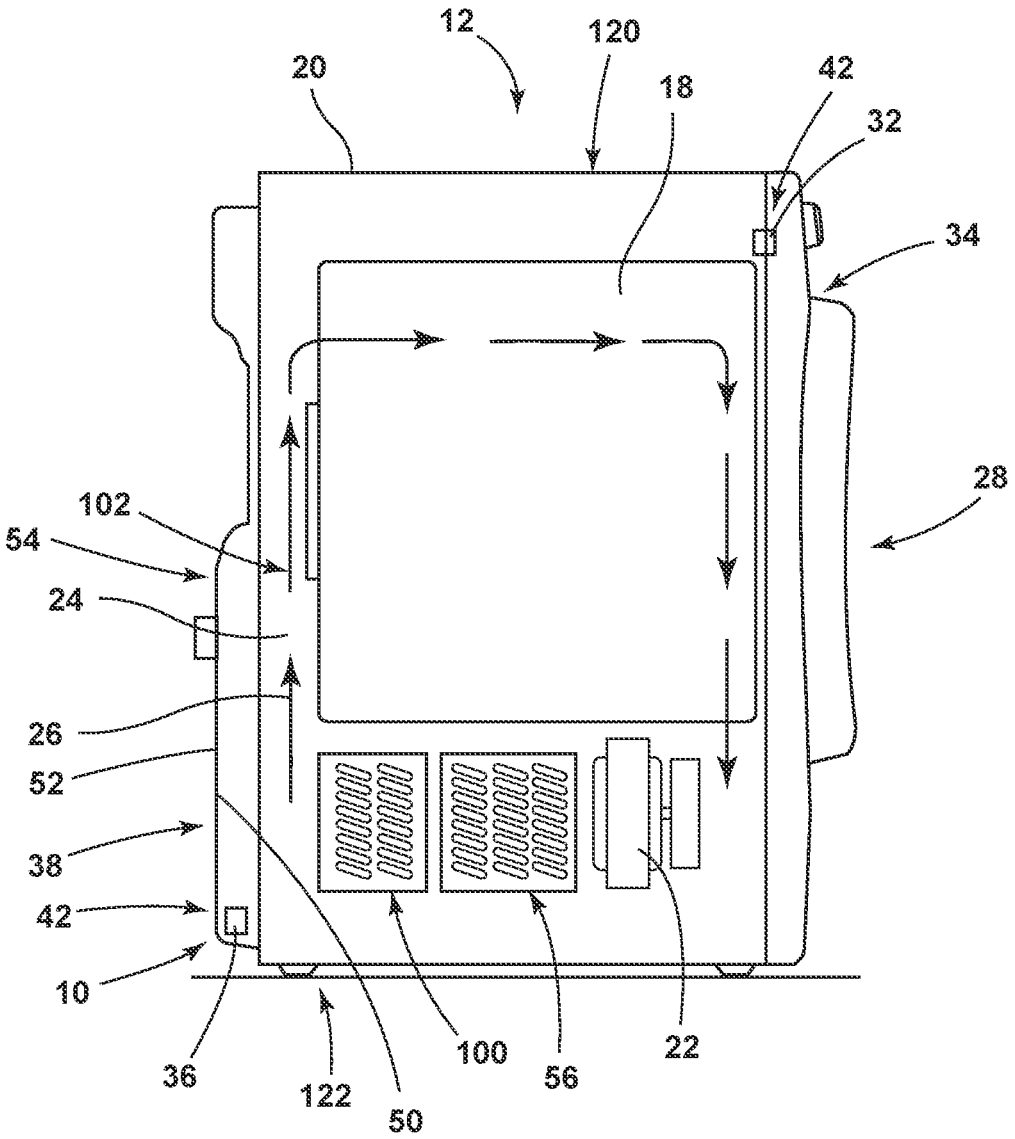
FIG. 1 is a schematic cross-sectional view of an aspect of a drying appliance that incorporates an aspect of a ventilation system.

The components in the figures are not necessarily to scale, emphasis instead being placed upon illustrating the principles described herein.

DETAILED DESCRIPTION

The present illustrated embodiments reside primarily in combinations of method steps and apparatus components related to a ventilation system for a closed-loop drying appliance that provides for fresh-air ventilation when the appliance is deactivated. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 2:
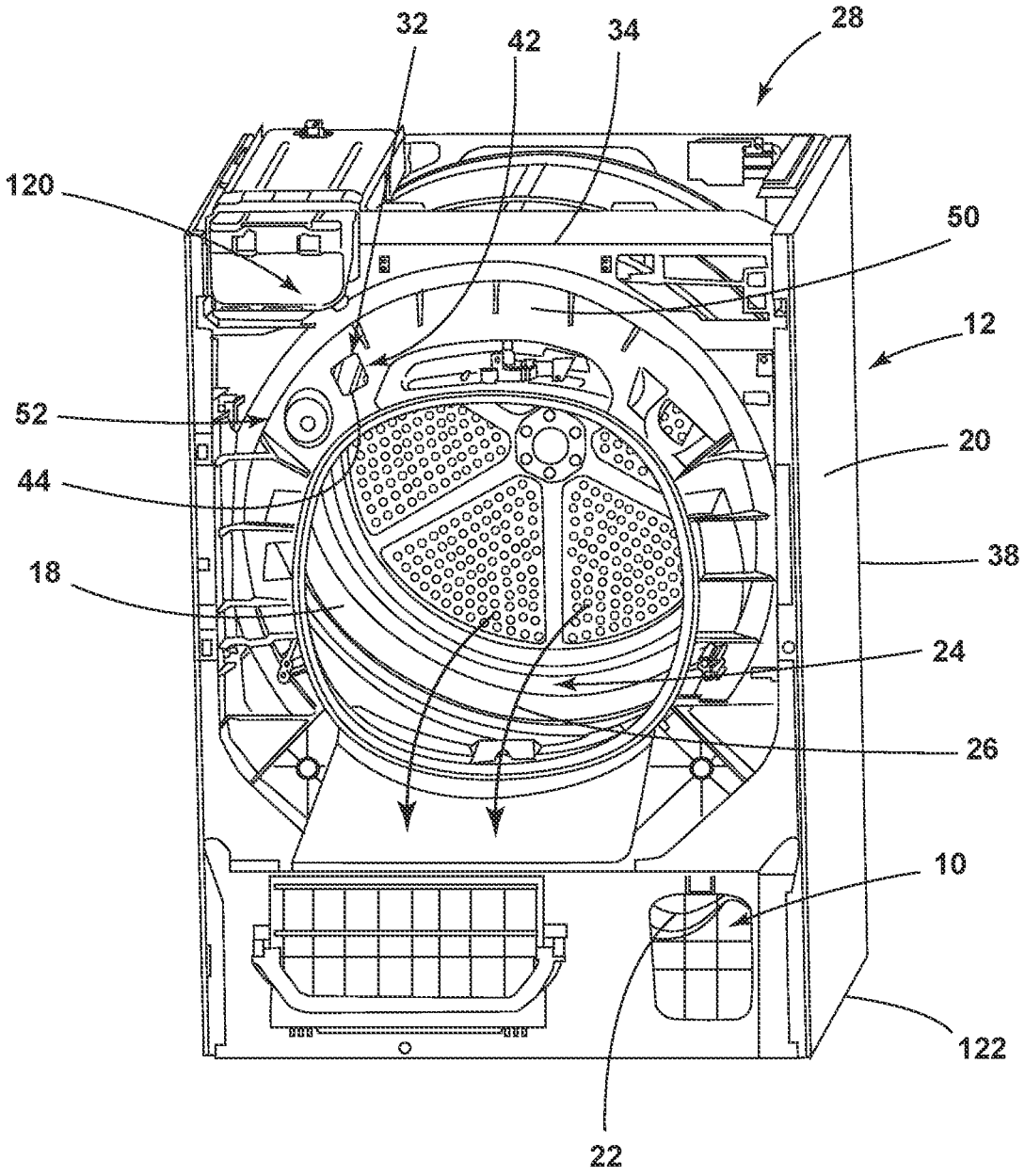
FIG. 2 is a front perspective view of the laundry appliance of FIG. 1 with the outer cabinet removed and showing the location of a first operable vent.
Figure 3:
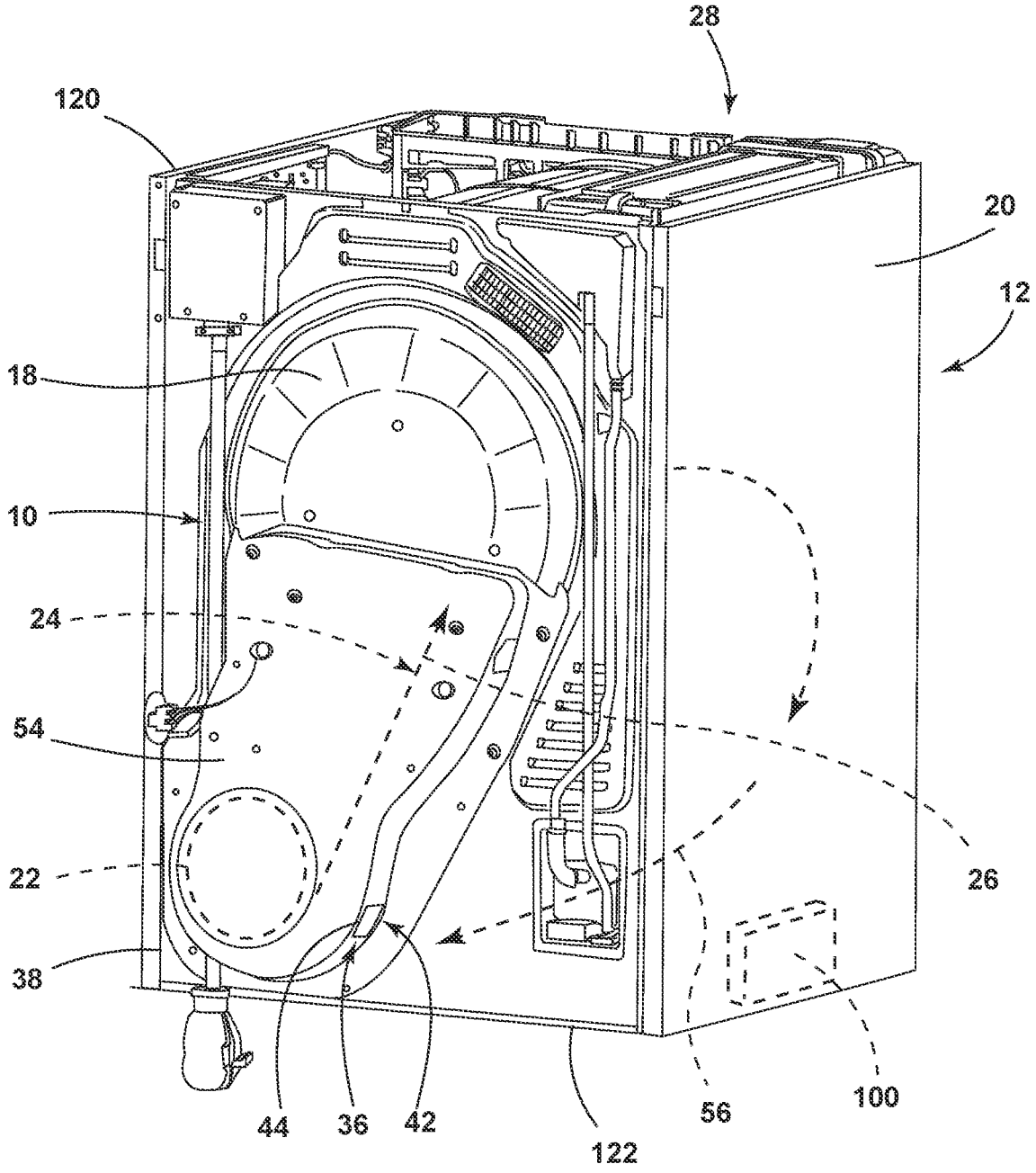
FIG. 3 is a rear perspective view of the appliance of FIG. 2 and showing an exemplary location of a second operable vent.
Figure 4:
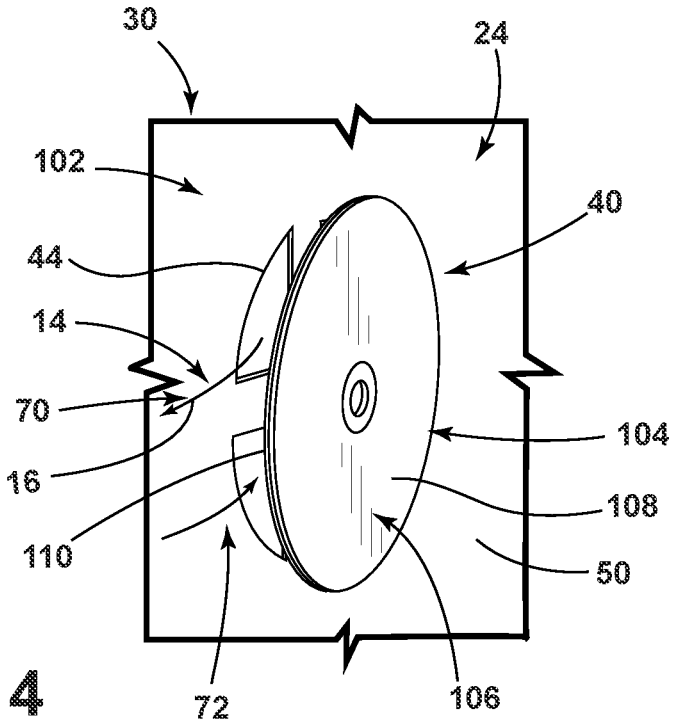
FIG. 4 is a perspective view of a thermally-operated vent in an open position.
Figure 5:
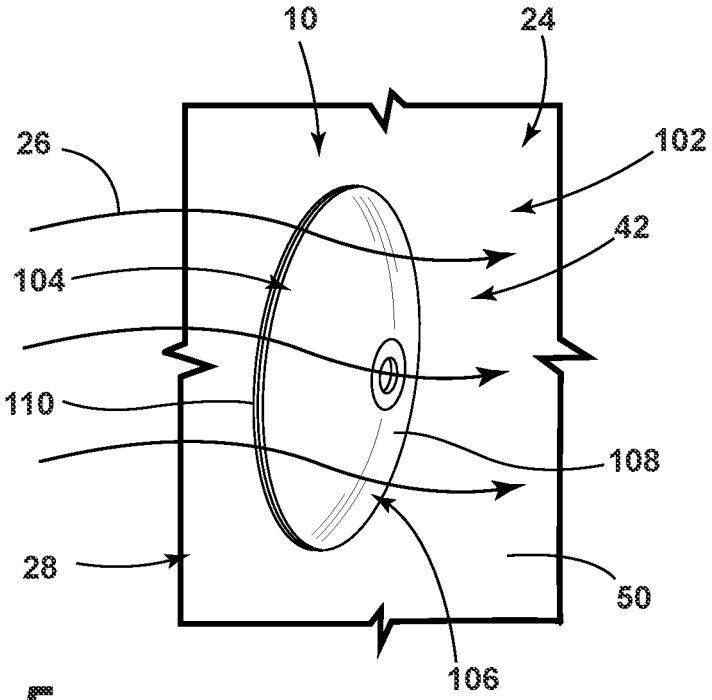
FIG. 5 is a perspective view of the thermally-operated vent of FIG. 4 shown in a closed position.
Figure 6:
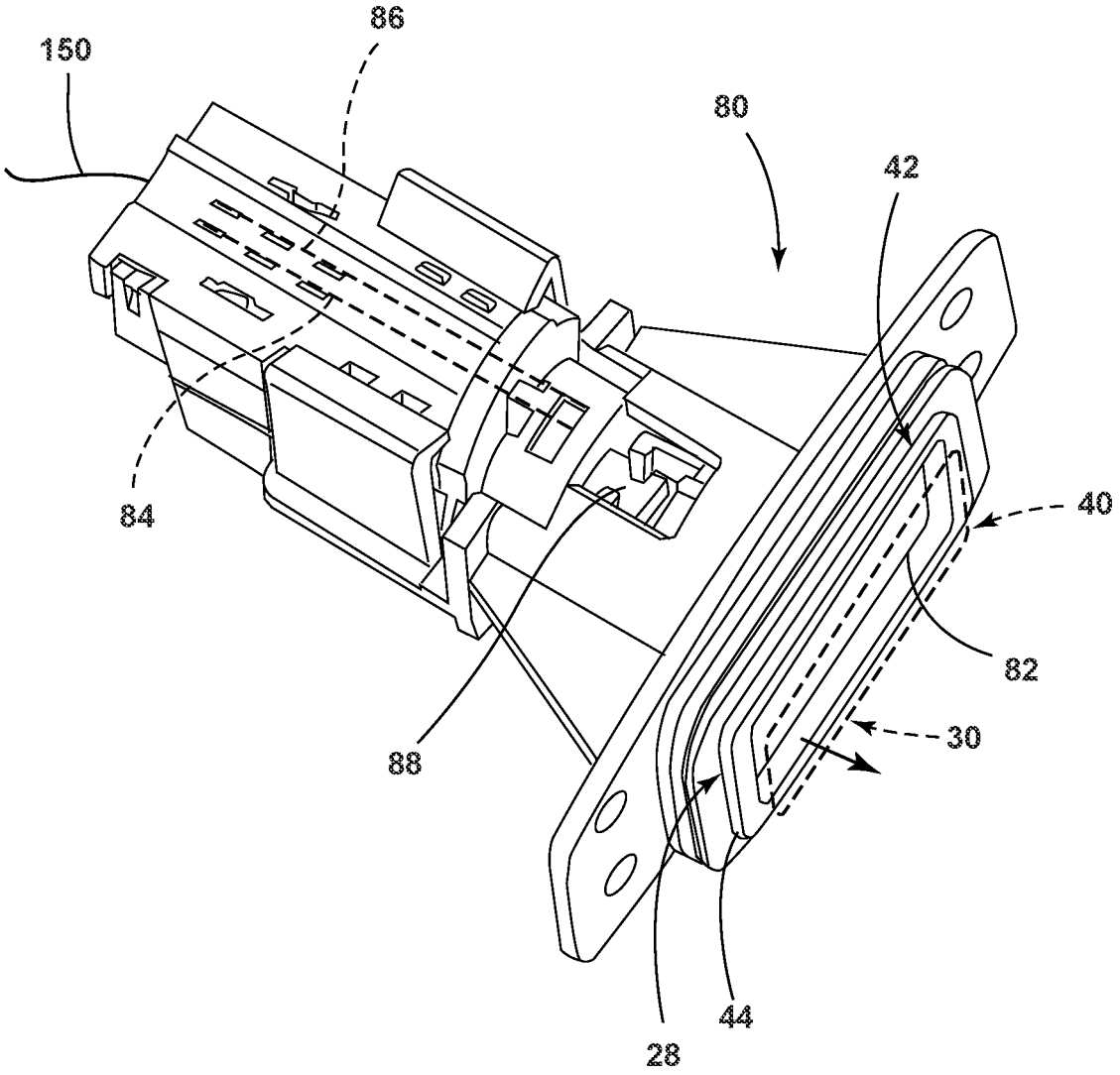
FIG. 6 is a schematic perspective view of a wax motor for use within the ventilation system of the appliance.
Figure 7:
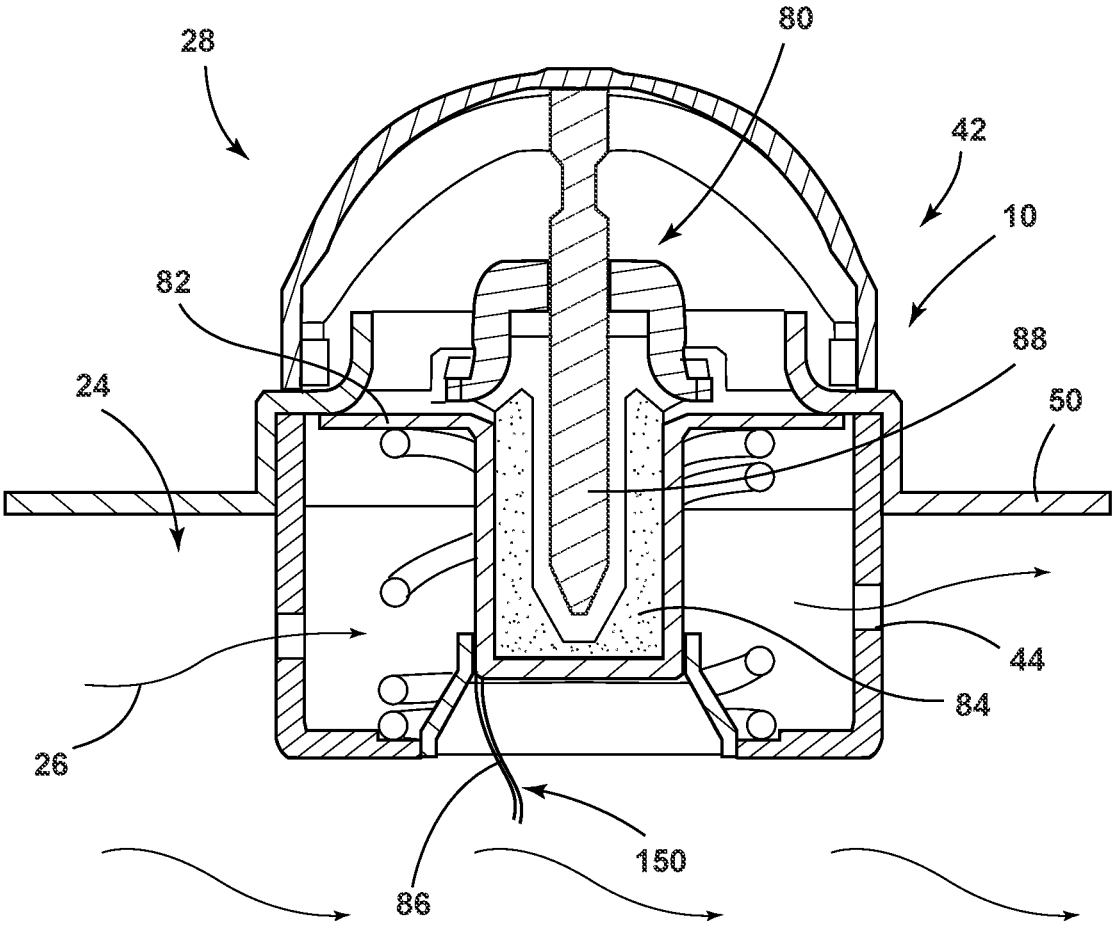
FIG. 7 is a schematic perspective view of the wax motor shown in a closed position.

With respect to FIGS. 1-3, reference numeral 10 generally refers to a ventilation system incorporated within a laundry appliance 12. The ventilation system 10 is utilized within closed-loop laundry appliances to provide for a ventilating airflow 14 of fresh or ambient air 16 through a rotating drum 18 when the laundry appliance 12 is deactivated. According to various aspects of the device, the laundry appliance 12, typically in the form of a laundry appliance, includes a drum 18 that processes articles of laundry. The drum 18 is positioned for rotational operation within an outer cabinet 20. A blower 22 directs process air 26 through a recirculating airflow path 24 that includes the drum 18. This recirculating airflow path 24 is typically in the form of a closed-loop system that recirculates process air 26 through the drum 18. The drum 18 and the blower 22 are activated in an operating state 28 and deactivated in an idle state 30. A first operable vent 32 is positioned proximate a front 34 of the cabinet 20. A second operable vent 36 is positioned proximate a rear 38 of the cabinet 20. The first and second operable vents 32, 36 each define an open position 40 after the drum 18 and blower 22 define the idle state 30. The first and second operable vents 32, 36 each operate to define a closed position 42 after the drum 18 and the blower 22 define the operating state 28. In the open position 40 of the first and second operable vents 32, 36, the ventilation system 10 experiences a venting airflow of ambient air 16 through the first and second operable vents 32, 36 and the drum 18. In this manner, the recirculating airflow path 24, using the first and second operable vents 32, 36, is opened when the appliance 12 is deactivated to provide for the venting airflow of ambient air 16 through the drum 18.

Referring again to FIGS. 2 and 3, the first operable vent 32 is positioned within a vent aperture 44 defined within a wall 50 of an airflow path 24 proximate the drum 18 of the appliance 12. The first operable vent 32 can be positioned along a dedicated channel of the airflow path 24 of within a structural panel 52 that supports or surrounds a portion of the drum 18. The first operable vent 32 is positioned to allow process air 26 within the drum 18 to escape, and also to allow ambient air 16 to enter into the drum 18. The second operable vent 32, 36 is positioned within an air scroll panel 54 that conceals the blower 22 within the cabinet 20 and also defines a portion of the recirculating airflow path 24 therein. The airflow path 24 operates to direct process air 26 from the blower 22 within the air scroll panel 54 and moves the process air 26 into the drum 18. The process air 26 moves through the drum 18 and circulates within the drum 18. The process air 26 then moves through a return portion 56 of the airflow path 24 back to the blower 22. Certain filters, heaters 100, heat exchangers, and other mechanical devices are incorporated within the airflow path 24 for treating and conditioning the process air 26 that is utilized during operation of the appliance 12.

The first operable vent 32 can be positioned proximate the drum 18 and within a structural panel 52 for the appliance 12. In this manner, the first operable vent 32 allows for air within the drum 18 to passively move through the first operable vent 32 when the appliance 12 is deactivated. Similarly, the second operable vent 36 within the air scroll panel 54 operates to the open position 40 to allow for ambient air 16 to enter within the airflow path 24 and move through the drum 18. It should be understood that each of the first and second operable vents 32, 36 each provide for inward and outward flow of ambient air 16 such that the venting airflow of ambient air 16 can occur in an inward direction 70 and an outward direction 72 through each of the first and second operable vents 32, 36.

Referring now to FIGS. 2-8, the first operable vent 32 can include a wax motor 80, sometimes referred to as a wax actuator, that is operable to move the vent member 82 between the open position 40 and the closed position 42. The wax motor 80 can operate by thermally acting on a wax member 84. This wax member 84 can expand and contract based upon the temperature of an element 86 within the wax motor 80. This element 86 can be an electrically resistive heating element 86 that, when activated, heats the wax member 84 and causes the wax to expand. This expansion of the wax member 84 causes movement of an actuator 88 within the wax motor 80. The actuator 88, in turn, biases the vent member 82 between the open and closed positions 40, 42.

In the case of the ventilation system 10 described herein, when the appliance 12 is activated, the wax motor 80 can be activated such that the actuator 88 moves to the closed position 42 so that the process air 26 is contained within the recirculating airflow path 24. When the appliance 12 is deactivated, an electrical signal delivered to the wax motor 80 for heating the element 86 and the wax member 84 can be stopped such that the element 86 cools and the wax member 84 contracts. This contraction of the wax member 84 causes the actuator 88 to move to a rest position, resulting in an opening of the vent member 82. As discussed above, this opening of the first operable vent 32 allows for the ventilating airflow 14 of ambient air 16 through the drum 18 and the recirculating airflow path 24. According to various aspects of the device, it is contemplated that operation of the wax motor 80 can be reversed such that the electrical signal is provided when the appliance 12 is deactivated, so that the wax is heated and the vent is opened when the appliance 12 is deactivated.

Referring again to FIGS. 2-8, the recirculating airflow path 24 includes a heater 100 that modifies an air temperature 102 of the process air 26 within the recirculating airflow path 24. The second operable vent 36 includes a bi-metal disk 104 that operates between the open and closed positions 40, 42 based upon the air temperature 102 of the process air 26. The bi-metal disk 104 moves to the closed position 42 when a material temperature 106 of the bi-metal disk 104 reaches a threshold temperature. The bi-metal disk 104 moves to the open position 40 when the material temperature 106 of the bi-metal disk 104 is below this threshold temperature. The bi-metal disk 104 operates using two different metals that have different thermal properties. A first layer 108 of the bi-metal disk 104 deflects at a first temperature, and a second layer 110 of the bi-metal disk 104 operates at a second temperature, that is different from the first temperature. It is also contemplated that the first and second layers 108, 110 may deflect different amounts in response to thermal variations in the material temperature 106. Expansion of a first layer 108 relative to the second layer 110 causes the bi-metal disk 104 to deflect between the open and closed positions 40, 42. The air temperature 102 of the process air 26 moving past the bi-metal disk 104 causes the material temperature 106 to change within the bi-metal disk 104. These changes in the material temperature 106 of the bi-metal disk 104 result in deflection of the bi-metal disk 104 between the open and closed positions 40, 42.

As discussed above, in the closed position 42, the bi-metal disk 104 is typically heated at least to the threshold temperature, such that the bi-metal disk 104 deflects to the closed position 42. The closed position 42 of the bi-metal disk 104 encloses the recirculating airflow path 24. When the temperature of the bi-metal disk 104 falls below the threshold temperature, after the appliance 12 is deactivated, the bi-metal disk 104 deflects to the open position 40 and thereby opens the recirculating airflow path 24 to allow for the venting airflow of ambient air 16 to move through the drum 18 and through the recirculating airflow path 24. Through the configuration of the first and second operable vents 32, 36, the closed position 42 defines a closed loop of the recirculating airflow path 24 through the drum 18. When the first and second operable vents 32, 36 are moved to the respective open position 40, the first and second operable vents 32, 36 define an open loop venting airflow path 24 through the drum 18 and through the recirculating airflow path 24.

Referring again to FIGS. 2 and 3, the positioning of the first and second operable vents 32, 36 provides movement of the venting airflow path 24 through the drum 18. The first operable vent 32 is positioned at front 34 of the appliance 12 and the second operable vent 36 is positioned at a rear 38 of the appliance 12. Additionally, the first operable vent 32 is positioned at top section 120 within an elevated position relative to the drum 18 and the second operable vent 36 is located in a lower section 122 of the appliance 12, typically below the level of the drum 18 and near a bottom of the air scroll panel 54. The differing elevations of the first and second operable vents 32, 36 provides for a movement of heated process air 26 and cooler ambient air 16 through the drum 18 and through the open configuration of the recirculating airflow path 24 when the appliance 12 is deactivated. Warmer air, tending to rise, may tend toward the first operable vent 32. Conversely, cooled air, which tends to fall, may tend towards the second operable vent 36. Similarly, lighter components of gasses within the drum 18, such as carbon dioxide, may tend to escape through the first operable vent 32. The escaping carbon dioxide will typically be replaced by ambient air 16 that may enter through the second operable vent 36 positioned within the air scroll panel 54. These configurations and positions of the first and second operable vents 32, 36 tends to cause movement of ambient air 16 from outside of the appliance 12, through the first and second operable vents 32, 36 and through the drum 18 as well as the remainder of the recirculating airflow path 24.

According to various aspects of the device, the first and second operable vents 32, 36 can operate between the open and closed positions 40, 42 after the appliance 12 operates between the operating state 28 and the idle state 30. Once the appliance 12 enters the idle state 30, the air temperature 102 of the process air 26 within the recirculating airflow path 24 will be generally stagnant. It will take a period of time for the material temperature 106 of the bi-metal disk 104 to reach the threshold temperature and deflect to the open position 40. This delay can be used to ensure that the recirculating airflow path 24 remains closed during brief stoppages of the operating systems of the appliance 12 during a particular laundry cycle. Conversely, the wax motor 80, which is electrically operated, may have a very definite and predetermined actuating sequence with respect to the appliance 12 entering the idle state 30. By way of example, and not limitation, the wax motor 80 may move to the open position 40 when the laundry cycle is completed, with little to no delay. The wax motor 80 may also operate to the open position 40 after a predetermined time period has lapsed. The operating configuration of the various mechanisms for the first and second operable vents 32, 36 may vary depending on the design of the appliance 12 and the needs for allowing the ventilating airflow 14 of ambient air 16 to move through the drum 18.

According to the various aspects of the device, as discussed herein, each of the first and second operable vents 32, 36 can each include a temperature-operated member that operates based upon some temperature fluctuation that occurs within or around the first and second operable vents 32, 36. In the case of the bi-metal disk 104, the temperature fluctuations occur in the air temperature 102 of the process air 26 surrounding the bi-metal disk 104. The material temperature 106 of the bi-metal disk 104, in turn, fluctuates to operate between the open and closed positions 40, 42. In the case of the wax motor 80, the temperature fluctuations are electrically operated through the heating the element 86 and the wax member 84. These temperature fluctuations operate the vent member 82 of the wax motor 80 between the open and closed positions 40, 42. In these instances, the temperature-operated members of the first and second operable vents 32, 36 operate to the open position 40 upon reaching an opening temperature range. Conversely, the temperature-operated members of the first and second operable vents 32, 36 operate to the closed position 42 upon reaching a closing temperature range. Typically, the closing temperature range includes temperatures that are below the opening temperature range; although, the opposite may be the case in certain aspects of the device.

Referring again to FIGS. 1-8, the ventilation system 10 for the drying appliance 12 includes the blower 22 that directs process air 26 through the recirculating airflow path 24 in an operating state 28. The recirculating airflow path 24 includes a processing chamber, typically a rotating drum 18. Deactivation of the blower 22 can define an idle state 30 of the ventilation system 10. The first operable vent 32 is positioned proximate a front portion of the recirculating airflow path 24 and the second operable vent 36 is positioned proximate a rear portion of the recirculating airflow path 24. The first and second operable vents 32, 36 define a closed position 42 during the operating state 28 that is indicative of the recirculating airflow path 24 being a closed-loop system. Conversely, the first and second operable vents 32, 36 define an open position 40 during the idle state 30. This opening of the first and second operable vents 32, 36 forms a venting airflow of ambient air 16 through the processing chamber and between the first and second operable vents 32, 36. As discussed above, the first operable vent 32 is positioned within a top section 120 of the recirculating airflow path 24 and the second operable vent 32, 36 is positioned within a lower section 122 of the recirculating airflow path 24.

Figure 8:
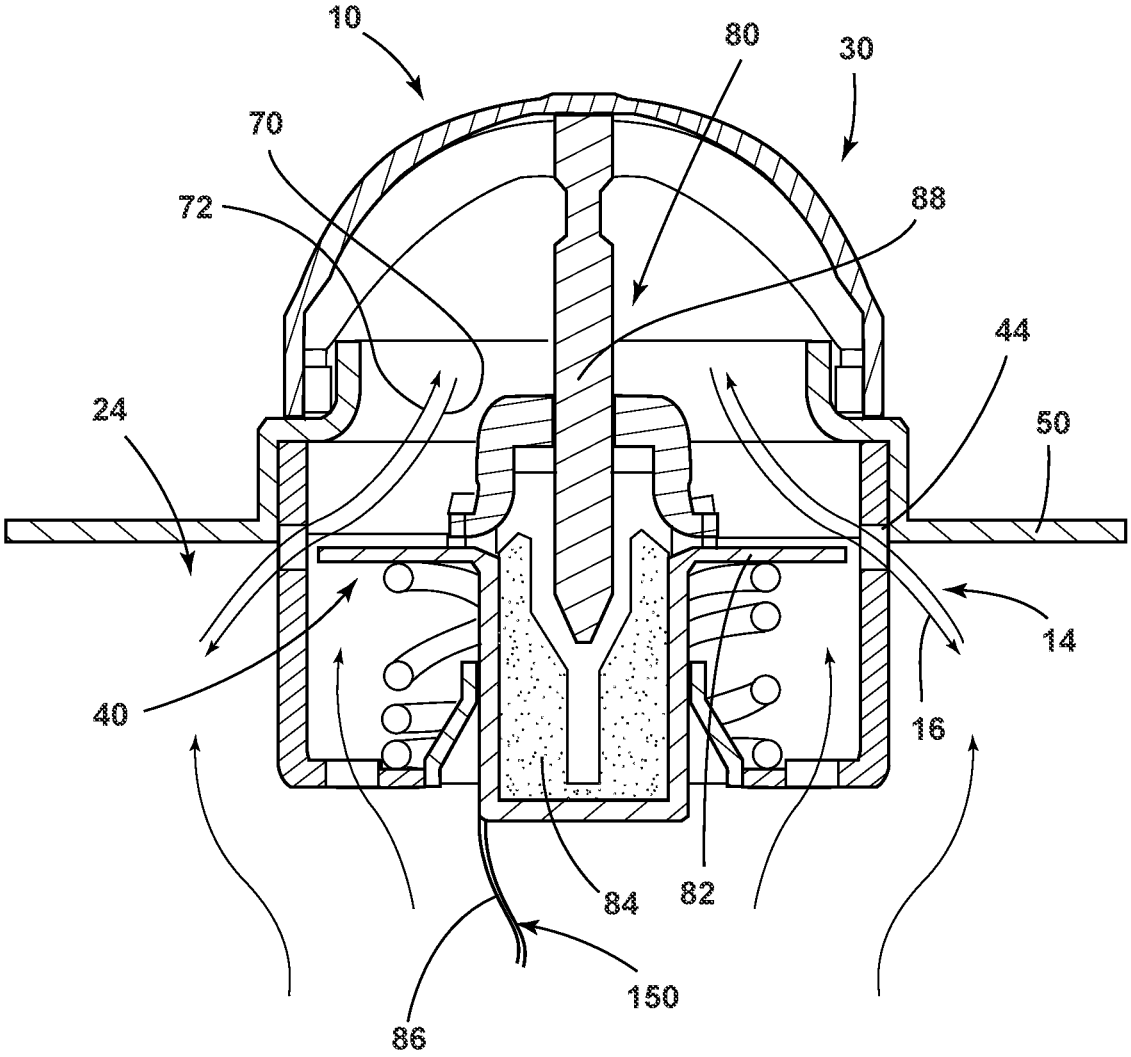
FIG. 8 is a schematic perspective view of the wax motor of FIG. 7 and shown in an open position.
Figure 9:
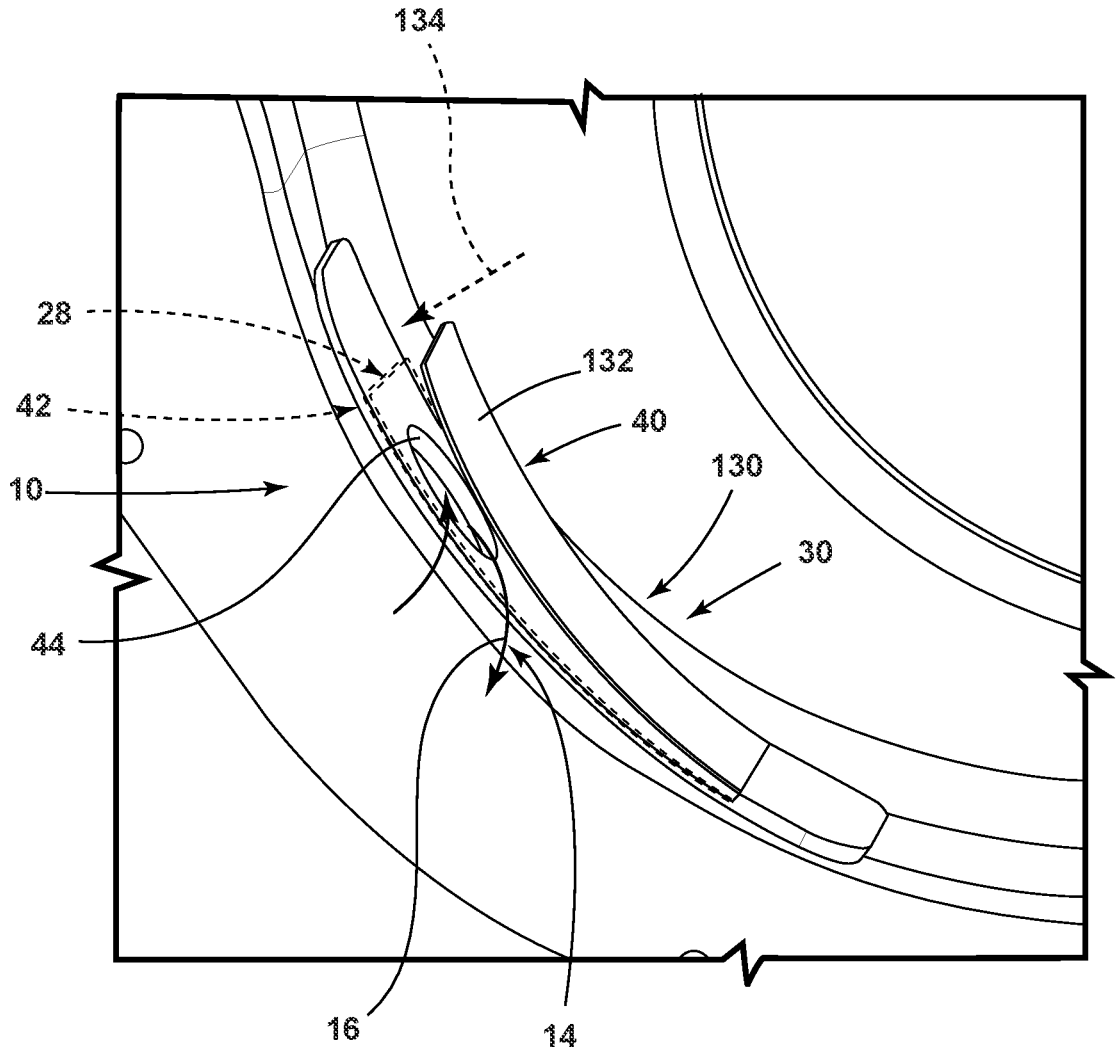
FIG. 9 is a perspective view of a pressure-operated operable vent shown in an open position.

Referring now to FIG. 8, it is contemplated that one of the first and second operable vents 32, 36 can include a pressure-sensitive operable vent 130. The pressure-sensitive operable vent 130 can include a flap 132 that is positioned at a vent aperture 44 of the recirculating airflow path 24. When the blower 22 is activated, the pressure 134 of the process air 26 moving through the recirculating airflow path 24 biases the pressure-sensitive operable vent 130 to the closed position 42 and covering the vent aperture 44. When the blower 22 is deactivated, the pressure 134 of the process air 26 through the recirculating airflow path 24 decreases. This decrease in pressure 134 within the recirculating airflow path 24 allows the pressure-sensitive operable vent 130 to return to a resting state that is indicative of an open position 40 of the pressure-sensitive operable vent 130. Accordingly, when the blower 22 is deactivated, the pressure-sensitive operable vent 130 is moved to the open position 40 to allow for the movement of the venting airflow of ambient air 16 through the drum 18 and the recirculating airflow path 24.

Referring again to FIGS. 1-8, the drying appliance 12 includes the blower 22 that directs process air 26 through the recirculating airflow path 24 that includes the drum 18. The heater 100 selectively heats the process air 26. At least one of the blower 22, the drum 18 and the heater 100 are activated in an operating state 28. Conversely, each of the blower 22, the drum 18 and the heater 100 are deactivated in the idle state 30. A first temperature-operable vent is positioned proximate a front 34 of the cabinet 20. A second temperature-operable vent is positioned proximate a rear 38 of the vent. The first and second temperature-operable vents define open positions 40 after the blower 22, the drum 18 and the heater 100 define the idle state 30. The first and second temperature-operable vents define a closed position 42 after at least the blower 22 and the heater 100 define the activated state. As discussed above, the first and second temperature-operable vents are indicative of the first and second operable vents 32, 36 described herein. The first operable vent 32 typically includes a wax motor 80 having a resistive heating element 86. In this manner, the first operable vent 32 is an electrically-actuated vent. This electrical current 150 is used to heat a heating element 86 within the wax motor 80 that expands the wax member 84 to operate an actuator 88 within the wax motor 80. This actuator 88 can move the first operable vent 32 either to the open position 40 or to the closed position 42, depending upon the configuration of the appliance 12 and the design of the wax motor 80 within the recirculating airflow path 24. The second operable vent 36 can include a bi-metal disk 104 that deflects based upon the material temperature 106 of the bi-metal disk 104. This material temperature 106 of the bi-metal disk 104 is typically dictated by the air temperature 102 of the process air 26 moving through the recirculating airflow path 24, in particular, the air temperature 102 of the process air 26 moving past the bi-metal disk 104. As discussed above, the bi-metal disk 104 includes first and second layers 108, 110 that are attached together to form the bi-metal disk 104. The thermal properties of these first and second layers 110 are dissimilar such that a first layer 108 expands at a different temperature or at a different rate than the second layer 110, thereby causing the bi-metal disk 104 to deflect in response to changes in the material temperature 106 within the first and second layers 108, 110 of the bi-metal disk 104.

Referring again to FIGS. 1-8, the exact configuration of the first and second operable vents 32, 36 can vary depending upon the configuration of the appliance 12. Typically, the first operable vent 32 will be in the form of a wax motor 80 and the second operable vent 36 will be in the form of the bi-metal disk 104 or the pressure-sensitive operable vent 130. It is contemplated that other operable vent configurations can be used to operate the first and second operable vents 32, 36 between the open and closed positions 40, 42.

Referring now to FIG. 10, an exemplary diagram is included illustrating various exemplary testing data using the configurations of the ventilating system, as described herein. In each of these configurations, the wax motor 80 was used for the first operable vent 32 and the bi-metal disk 104 was used for the second operable vent 36. In each of these cases, the carbon dioxide content within the drum 18 was maintained below 3% and the oxygen content within the drum 18 was maintained above 17% at all times. The operation of the first and second operable vents 32, 36 to the open position 40 when the appliance 12 is deactivated allowed for the ventilating airflow 14 of ambient air 16 through the drum 18 and the recirculating airflow path 24. Accordingly, the environment within the drum 18, when the appliance 12 is deactivated, provided for a safe level of noxious gasses, as well as a safe level of oxygen within the drum 18. These features provide for a breathable environment when the appliance 12 is deactivated.

The ventilation system 10 described herein can be useful in various laundry appliances 12. Such appliances 12 can include, but are not limited to, drying appliances, combination drying appliances, refreshing drying appliances, and other similar appliances that include a flow of recirculating air through a closed-loop airflow path 24. In addition, the size of the first and second operable vents 32, 36 can vary depending upon the size of the drum 18 and the configuration of the recirculating airflow path 24 within the appliance 12.

According to another aspect of the present disclosure, a drying appliance includes a cabinet. A drum processes articles of laundry. The drum is positioned for rotational operation within the cabinet. A blower directs process air through a recirculating airflow path that includes the drum. The drum and the blower are activated in an operating state and deactivated in an idle state. A first operable vent is positioned proximate a front of the cabinet. A second operable vent is positioned proximate a rear of the cabinet. The first and second operable vents define an open position after the drum and the blower define the idle state. The first and second operable vents define a closed position after the drum and the blower define the operating state.

According to another aspect, the open position of the first and second operable vents defines a venting airflow of ambient air through the drum.

According to yet another aspect, the first operable vent is positioned within a wall of the recirculating airflow path proximate the drum.

According to another aspect of the present disclosure, the second operable vent is positioned within an air scroll panel that conceals the blower within the cabinet.

According to another aspect, the first operable vent includes a wax motor that is operable to move a vent member between the open position and the closed position.

According to yet another aspect, the recirculating airflow path includes a heater that modifies an air temperature of the process air and the second operable vent includes a bi-metal disk that operates between the open and closed positions based upon the air temperature of the process air.

According to another aspect of the present disclosure, the bi-metal disk moves to the closed position when a temperature of the bi-metal disk reaches a threshold temperature. The bi-metal disk moves to the open position when the temperature of the bi-metal disk is below the threshold temperature.

According to another aspect, the closed position of the first and second operable vents defines a closed loop of the recirculating airflow path through the drum. The open position of the first and second operable vents defines an open loop venting airflow path through the drum.

According to yet another aspect, a ventilation system for a drying appliance includes a blower that directs process air through a recirculating airflow path in an operating state. The recirculating airflow path includes a processing chamber. Deactivation of the blower defines an idle state. A first operable vent is positioned proximate a front portion of the recirculating airflow path. A second operable vent is positioned proximate a rear portion of the recirculating airflow path. The first and second operable vents define a closed position during the operating state that is indicative of the recirculating airflow path being a closed-loop system. The first and second operable vents define an open position during the idle state that forms a venting airflow of ambient air through the processing chamber and between the first and second operable vents.

According to another aspect of the present disclosure, the first operable vent is positioned within a top section of the recirculating airflow path and the second operable vent is positioned within a lower section of the recirculating airflow path.

According to another aspect, the first operable vent includes an electrically-actuated vent.

According to yet another aspect, the electrically-actuated vent is a wax motor having a resistive heating element.

According to another aspect of the present disclosure, the second operable vent includes a temperature-operated member that operates to an open position upon reaching an opening temperature range and wherein the temperature-operated member operates to a closed position upon reaching a closing temperature range. The closing temperature range includes temperatures that are below the opening temperature range.

According to another aspect, the temperature-operated member operates between the open and closed positions based upon an air temperature of the process air within the airflow path.

According to yet another aspect, the recirculating airflow path includes a heater. The heater modifies an air temperature of the process air and wherein the temperature-operated member operates between the open and closed positions based upon the air temperature of the process air within the airflow path.

According to another aspect of the present disclosure, the temperature-operable member includes a bi-metal disk.

According to another aspect, a drying appliance includes a blower that directs process air through a recirculating airflow path that includes a drum. A heater selectively heats the process air, wherein at least one of the blower, the drum and the heater are activated in an operating state and wherein all of the blower, the drum and the heater are deactivated in an idle state. A first temperature-operable vent is positioned proximate a front of a cabinet. A second temperature-operable vent is positioned proximate a rear of the cabinet. The first and second temperature-operable vents define an open position after the blower, the drum and the heater define the idle state. The first and second temperature-operable vents define a closed position after at least the blower and the heater define the operating state.

According to yet another aspect, the first temperature-operable vent is a wax motor having a resistive heating element.

According to another aspect of the present disclosure, the second temperature-operable vent is a bi-metal disk.

According to another aspect, the bi-metal disk operates between the open and closed positions based upon an air temperature of the process air. The wax motor operates between the open and closed positions based upon an electrical current delivered to the wax motor. It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A drying appliance comprising:

a cabinet;

a drum that processes articles of laundry, the drum positioned for rotational operation within the cabinet;

a blower that directs process air through a recirculating airflow path that includes the drum, wherein the drum and the blower are activated in an operating state and deactivated in an idle state; and a first operable vent positioned proximate a front of the cabinet; and a second operable vent positioned proximate a rear of the cabinet, wherein the first and second operable vents define an open position after the drum and the blower define the idle state, and wherein the first and second operable vents define a closed position after the drum and the blower define the operating state.

2. The drying appliance of claim 1, wherein the open position of the first and second operable vents defines a venting airflow of ambient air through the drum.

3. The drying appliance of claim 1, wherein the first operable vent is positioned within a wall of the recirculating airflow path proximate the drum.

4. The drying appliance of claim 3, wherein the second operable vent is positioned within an air scroll panel that conceals the blower within the cabinet.

5. The drying appliance of claim 3, wherein the first operable vent includes a wax motor that is operable to move a vent member between the open position and the closed position.

6. The drying appliance of claim 1, wherein the recirculating airflow path includes a heater that modifies an air temperature of the process air and wherein the second operable vent includes a bi-metal disk that operates between the open and closed positions based upon the air temperature of the process air.

7. The drying appliance of claim 6, wherein the bi-metal disk moves to the closed position when a temperature of the bi-metal disk reaches a threshold temperature, and wherein the bi-metal disk moves to the open position when the temperature of the bi-metal disk is below the threshold temperature.

8. The drying appliance of claim 4, wherein the second operable vent is a pressure operable flap that operates to the closed position in the operating state and moves to the open position in the idle state.

9. A ventilation system for a drying appliance, the ventilation system comprising:

a blower that directs process air through a recirculating airflow path in an operating state, wherein the recirculating airflow path includes a processing chamber, and wherein deactivation of the blower defines an idle state;

a first operable vent positioned proximate a front portion of the recirculating airflow path; and a second operable vent positioned proximate a rear portion of the recirculating airflow path, wherein:

the first and second operable vents define a closed position during the operating state that is indicative of the recirculating airflow path being a closed-loop system; and the first and second operable vents define an open position during the idle state that forms a venting airflow of ambient air through the processing chamber and between the first and second operable vents.

10. The ventilation system of claim 9, wherein the first operable vent is positioned within a top section of the recirculating airflow path and the second operable vent is positioned within a lower section of the recirculating airflow path.

11. The ventilation system of claim 9, wherein the first operable vent includes an electrically-actuated vent and the second operable vent includes a pressure operable vent.

12. The ventilation system of claim 11, wherein the electrically-actuated vent is a wax motor having a resistive heating element.

13. The ventilation system of claim 10, wherein the second operable vent includes a temperature-operated member that operates to an open position upon reaching an opening temperature range and wherein the temperature-operated member operates to a closed position upon reaching a closing temperature range, wherein the closing temperature range includes temperatures that are below the opening temperature range.

14. The ventilation system of claim 13, wherein the temperature-operated member operates between the open and closed positions based upon an air temperature of the process air within the recirculating airflow path.

15. The ventilation system of claim 14, wherein the recirculating airflow path includes a heater, wherein the heater modifies an air temperature of the process air and wherein the temperature-operated member operates between the open and closed positions based upon the air temperature of the process air within the recirculating airflow path.

16. The ventilation system of claim 15, wherein the temperature-operated member includes a bi-metal disk.

17. A drying appliance comprising:

a blower that directs process air through a recirculating airflow path that includes a drum;

a heater that selectively heats the process air, wherein at least one of the blower, the drum and the heater are activated in an operating state and wherein all of the blower, the drum and the heater are deactivated in an idle state;

a first temperature-operable vent positioned proximate a front of a cabinet; and a second temperature-operable vent positioned proximate a rear of the cabinet, wherein the first and second temperature-operable vents define an open position after the blower, the drum and the heater define the idle state and wherein the first and second temperature-operable vents define a closed position after at least the blower and the heater define the operating state.

18. The drying appliance of claim 17, wherein the first temperature-operable vent is a wax motor having a resistive heating element.

19. The drying appliance of claim 18, wherein the second temperature-operable vent is a bi-metal disk.

20. The drying appliance of claim 19, wherein the bi-metal disk operates between the open and closed positions based upon an air temperature of the process air, and wherein the wax motor operates between the open and closed positions based upon an electrical current delivered to the wax motor.

* * * * *